United States Patent [19]

Cohrs et al.

[11] Patent Number: 5,067,757

[45] Date of Patent: Nov. 26, 1991

[54] PANIC EXIT DEVICE HAVING NOISE SUPPRESSION

[75] Inventors: Richard B. Cohrs; Paul J. Haeck; Gary R. Jacobs, all of Indianapolis, Ind.

[73] Assignee: Von Duprin, Inc., Indianapolis, Ind.

[21] Appl. No.: 562,417

[22] Filed: Jul. 30, 1990

Related U.S. Application Data

[63] Continuation of Ser. No. 390,449, Aug. 2, 1989, abandoned, which is a continuation of Ser. No. 188,737, Apr. 29, 1988, abandoned, which is a continuation of Ser. No. 944,744, Dec. 22, 1986, abandoned.

[51] Int. Cl.[5] ..... E05B 65/10

[52] U.S. Cl. ..... 292/336.3; 292/92; 292/DIG. 73; 292/DIG. 56

[58] Field of Search ..... 292/DIG. 56, DIG. 73, 292/DIG. 8, 92, 1, 21, 144, DIG. 65; 70/92, 463; 16/DIG. 6, DIG. 9, DIG. 10, DIG. 21

[56] References Cited

U.S. PATENT DOCUMENTS

| | | | |
|---|---|---|---|
| 1,688,472 | 10/1928 | Shaw | 292/144 |
| 2,098,776 | 11/1937 | Edwards | 70/463 X |
| 3,645,572 | 2/1972 | McFarlane | 292/92 |
| 3,677,043 | 7/1972 | Cox | 70/92 |
| 4,075,734 | 2/1978 | Nagase | 16/DIG. 10 |
| 4,167,280 | 9/1979 | Godec et al. | 70/92 |
| 4,180,888 | 1/1980 | Nagase | 16/DIG. 10 |
| 4,324,425 | 4/1982 | Logan | 292/201 |
| 4,328,985 | 5/1982 | Logan | 292/201 |
| 4,342,135 | 8/1982 | Matsuo et al. | 16/DIG. 9 |
| 4,351,552 | 9/1982 | Van Der Linden | 292/201 |
| 4,354,699 | 10/1982 | Logan | 292/92 |
| 4,418,949 | 12/1983 | Horgan, Jr. | 292/DIG. 73 |
| 4,470,625 | 9/1984 | Walsh et al. | 292/92 |
| 4,540,208 | 9/1985 | Logan, Jr. et al. | 292/201 |
| 4,689,849 | 9/1987 | Eger et al. | 16/DIG. 10 |
| 5,011,199 | 4/1991 | Lowe et al. | 292/92 |

FOREIGN PATENT DOCUMENTS

| | | | |
|---|---|---|---|
| 553958 | 3/1958 | Canada | 16/DIG. 6 |
| 0009308 | 8/1979 | European Pat. Off. | 292/92 |
| 1584052 | 4/1969 | Fed. Rep. of Germany | 16/DIG. 9 |
| 1183003 | 3/1970 | United Kingdom | 292/92 |

*Primary Examiner*—Eric K. Nicholson

*Attorney, Agent, or Firm*—Walter C. Vliet; Bernard J. Murphy

[57] ABSTRACT

The Device is of the push pad type having a translating action rod which is biased in the latch bolt-extended position. An abutment is fixed to the action rod to receive thereagainst the extending plunger of a shock absorber which is removably coupled to an open guide base. The base is mounted on a base plate to support action rod operating bellcranks, and to support the action rod therein also. A shock absorber holder is clasped to the guide base, and the cylinder of the shock absorber, in which a viscous fluid is confined, is engaged by the holder to direct the plunger toward the abutment. In the depicted embodiment, the plunger resists retraction, to decelerate and damp the return of the push pad and action rod to their at-rest positions and, consequently, to suppress the operating noise of the panic exit device.

6 Claims, 2 Drawing Sheets

PANIC EXIT DEVICE HAVING NOISE SUPPRESSION

This application is a continuation of application Ser. No. 07/390,449, filed Aug. 2, 1989, which is a continuation of Ser. No. 07/188,737, filed on Apr. 29, 1988, which is a continuation of Ser. No. 07/944,744, filed on Dec. 22, 1986 all of which are now abandoned.

This invention pertains to a door hardware known as a panic exit device (by the Door Hardware Institute) and is most common in a push pad type exit device. The push pad version of the panic exit device is known to be more attractive and modern looking, offering enhanced features over the cross bar version of the device. However, the push pad style of the device can be very noisy because of the internal impacts of the push pad in the inward and outward motions.

The push pad assembly, in panic exit devices, is depressed to unlatch a door to allow access in or out of a building. The inward motion (downward) of the push pad of the assembly results in latch bolt retraction of the device. When the push pad is released, the latch bolt extends and the push pad returns to its original rest position. Prior art designs utilized rubber bumpers to reduce impact noise in both the inward and the back-to-rest positions of the push pad. The rubber bumper design concept has been marginally acceptable to customers in reducing impact noise, but something better has long been sought by the trade.

It is a feature of the invention to utilize a compliant force means as a hydraulic-type shock absorber to cushion impact of the push pad. Tests have indicated that the shock absorber may not be required in both the inward and return-to-rest movements. It is understood, however, that this concept could be used in either the inward movement, the return-to-rest movement, or both movements.

The concept of the hydraulic dampener or shock absorber is to freely release the push pad movement in one direction. In the other direction, fluid flow is orificed to reduce the force and speed of the return of the push pad, and its associated action rod and ancillary linkage.

The foregoing illustrates limitations known to exist in noise suppression of panic exit devices. Thus, it is apparent that it would be advantageous to provide an alternative directed to overcoming one or more limitations set forth above. Accordingly, a suitable alternative is provided including features more fully disclosed hereinafter.

SUMMARY OF THE INVENTION

In one aspect of the present invention, this is accomplished by providing a panic exit device having noise suppression comprising a means defining a bearing surface; an action rod; means joining said rod to said bearing surface for translation of said rod in opposite axial directions to operate a latch bolt in an opening direction and a locking direction; and compliant means coupled to one and bearing on the other of said rod and said bearing surface for damping and shock absorbing axial translation of said rod in said locking direction without impeding its operation in said opening direction and for limiting linkage lash in both said opposite axial directions of said rod.

BRIEF DESCRIPTION OF THE DRAWING FIGURES

DETAILED DESCRIPTION

Figure 1:
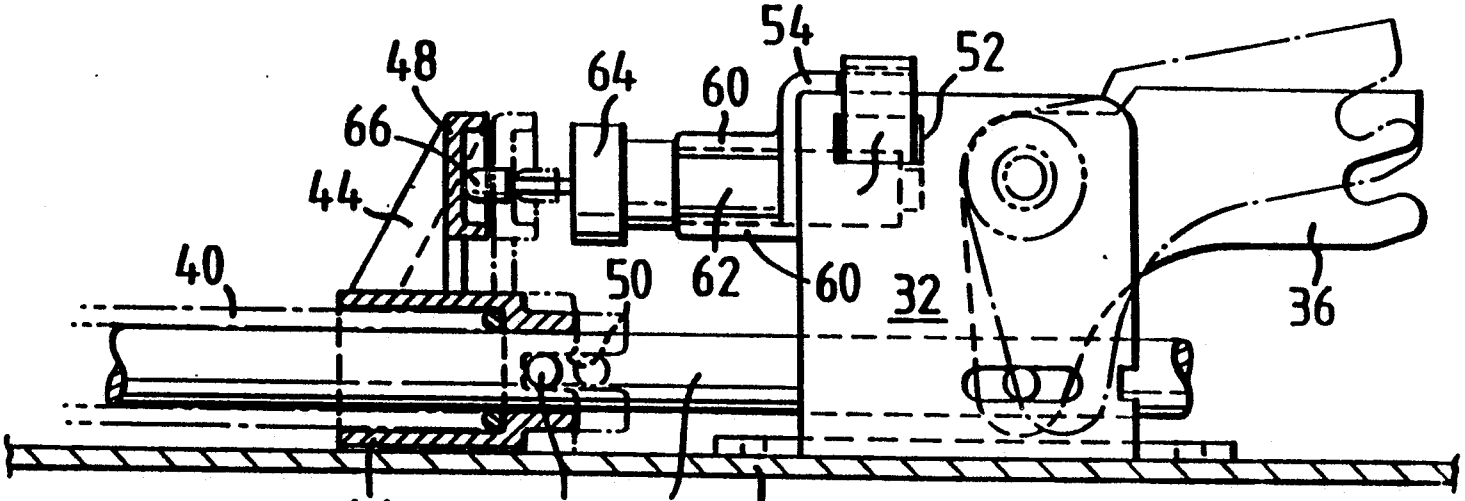
FIG. 1 is a detail illustration of the preferred embodiment of the invention in association with a prior art, panic exit device having an action rod.
Figure 2:
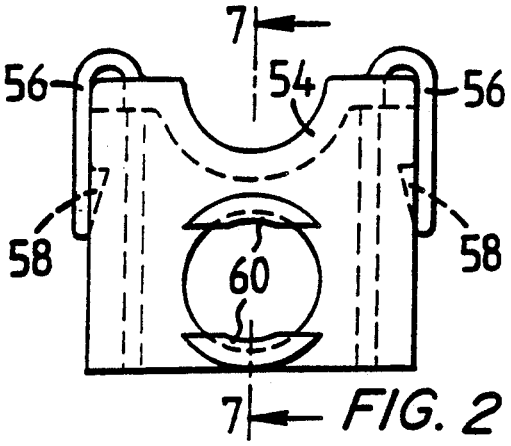
FIGS. 2 through 4 are enlarged illustrations of the shock absorber holder used in the FIG. 1 embodiment.
Figure 3:
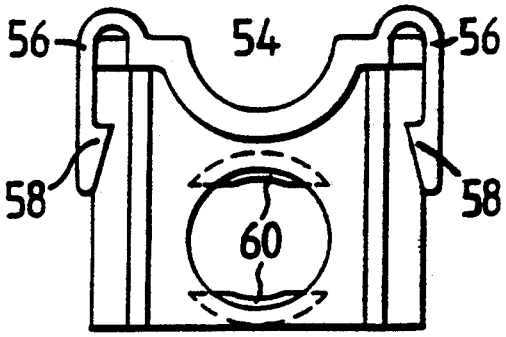
Figure 4:
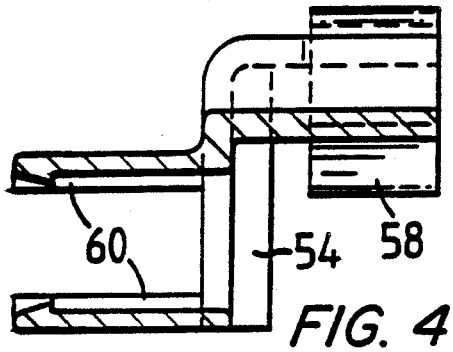
Figure 5:
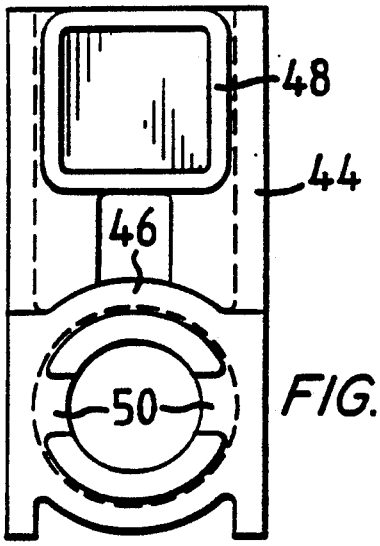
FIGS. 5 through 7 are enlarged illustrations of the abutment component used in the FIG. 1 embodiment.
Figure 6:
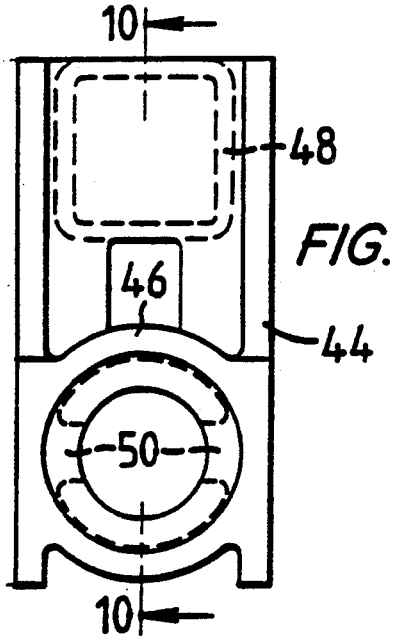
Figure 7:
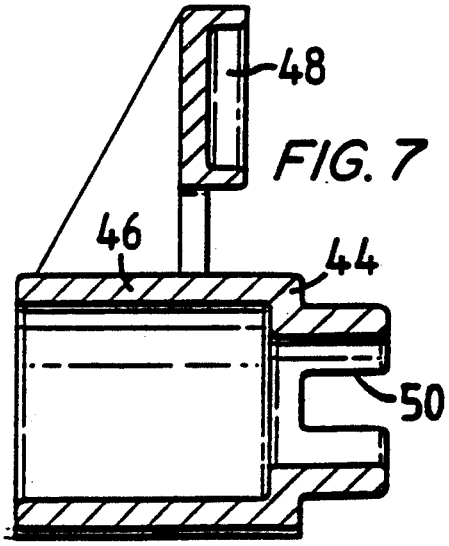

In FIGS. 1 through 7, is depicted a best-known embodiment of the invention as incorporated in a prior art type of panic exit device of the push pad style. Open guide bases 32 (only one is shown) are fixed to a base plate 34, and journal therein right-angular bellcranks 36 which, in turn, are coupled to a push pad (not shown, which causes the bellcranks to pivot on their pivot pins) and to a translating action rod 38. The latter is linked to a latch bolt (not shown), in the manner well known to those of ordinary skill in the art to which the invention pertains. In this embodiment, the latch bolt (not shown) is operated by the action rod 38, as noted. However, there are prior art panic exit devices which do not use action rods, per se. All panic exit devices do employ some sort of linkage means for retracting the latch bolt, and in this depicted embodiment, the action rod 38 is the linkage means which we employ. The compression spring 40, reacts from the limit stop pin 42 to urge the action rod 38 to the right (as viewed in FIG. 1). The broken line depictions in FIG. 1 show the dispositions of elements in the relaxed, or latch bolt-extended positioning of the panic exit device. The full-line illustrations depict the attitudes of the same components when the device is "pushed" to retract the latch bolt.

An abutment element 44, the same having a sleeve 46, in which to confine the one end of the spring 40, and an upstanding abutment 48, is slidably engaged with the action rod 38. The sleeve 46 has a large, inside diameter, in which to nest the spring 40 and rod 38, and an integral, smaller, inside diameter in which to confine only the rod. The latter portion of the sleeve 46 has a pair of slots 50 in which to receive the limit-stop pin 42 for the spring 40.

The open guide bases 32 have rectangular openings 52 formed in the side walls thereof, the same serving as sockets in which to latch a shock absorber holder 54. The holder 54 has a pair of resilient limbs 56 with tapered latches 58 which snap into the openings 52 to fix a pair of arcuate jaws 60 in extension from the guide base 32. The jaws 60 resiliently and removably receive therein the cylinder 62 of a viscous-fluid shock absorber 64. The plunger 66 of the absorber 64 (which absorber, by the way, is available from ACE Controls, Inc., P.O. Box 71, Farmington, Mich. 48024) is urged by an internal spring against the upstanding abutment 48. In this embodiment, the plunger 66 resists retraction, absorbs energy and causes a hydraulic deceleration, due to the metering of viscous fluid confined in the cylinder 62, of the action rod 38 as it moves from the latch bolt-open position to the return to rest position (with the latch bolt extended/closed). Since there is no attachment of the shock absorber 64 there is no impeding of the mechanism in the movement to the latch open position. In addition to controlling the speed of the return of the action rod and pad operating linkages associated there-with, the shock absorber by means of its applied (resilient) force tends to eliminate free slack in the mechanism which further contributes to the quieting of the action.

Having described the invention, what is claimed is:

1. A panic exit device means for operating a latch having noise suppression, comprising:

a base including means defining a bearing surface;

a push pad operating means journalled to said base including a linear translating action rod means whereby translation of said rod in opposite axial directions operates a latch bolt in an opening direction and a locking direction; and shock absorber means having a viscous fluid damped spring extended plunger coupled to one and bearing without attachment on the other of said rod and said bearing surface for damping and shock absorbing axial translation of said rod in said locking direction without impeding its operation in said opening direction and for limiting linkage slack in both said opposite axial directions of said rod.

2. A panic exit device, according to claim 1, wherein said shock absorber means comprises (a) a rod-support element mounted to said bearing surface, (b) an abutment coupled to said rod, and (c) viscous fluid damped means for controlling the speed of movement of said rod in said locking direction interposed between said element and said abutment.

3. A method of suppressing noise in a panic exit device means for operating a latch which has (a) a base including a push pad operating means journalled to said base, and (b) a linear translating action rod operatively connected to said push pad operating means for axially operating said latch in a panic open direction and a locking direction, comprising the steps of:

selectively dampening and shock absorbing translation of said rod by means of a viscous fluid damped shock absorber having a spring extended plunger interposed between said base and said action rod and bearing on said rod only in said locking direction and allowing disconnected unrestricted translation of said rod in said panic open direction.

4. A panic exit device having noise suppression, comprising:

means defining a bearing surface;

an action rod;

means joining said rod to said bearing surface for translation of said rod in opposite axial directions to operate a latch bolt in an opening direction and a locking direction;

compliant means disposed between said rod and said bearing surface for damping and shock absorbing axial translation of said rod in said locking direction without impeding its operation in said opening direction;

said compliant means comprises (a) a rod-support element mounted to said bearing surface, (b) an abutment coupled to said rod, and (c) means for compliantly retarding movement of said rod in said locking direction interposed between said element and said abutment; and said abutment comprises (a) a sleeve for slidably receiving said action rod therein; and (b) an arm coupled to, and projecting outwardly from, said sleeve.

5. A panic exit device having noise suppression, comprising:

means defining a bearing surface;

an action rod;

means joining said rod to said bearing surface for translation of said rod in opposite axial directions to operate a latch bolt in an opening direction and a locking direction;

compliant means disposed between said rod and said bearing surface for damping and shock absorbing axial translation of said rod in said locking direction without impeding its operation in said opening direction;

said compliant means comprises (a) a rod-support element mounted to said bearing surface, (b) an abutment coupled to said rod, and (c) means for compliantly retarding movement of said rod in said locking direction interposed between said element and said abutment;

said movement-resisting means comprises a shock absorber;

said element and said abutment comprise first and second means, respectively, for cooperatively supporting and functionally engaging said shock absorber;

said absorber comprises a viscous-fluid-confining cylinder, and a translating plunger extending from said cylinder;

said cylinder is mounted to one of said first and second means;

said plunger is biasingly engaged with the other of said first and second means;

said element has sockets formed therein; and further including a holder for said cylinder; wherein said holder has resilient limbs; and said limbs have portions thereof resiliently nested in said sockets for removably securing said holder to said element.

6. A method of suppressing noise in a panic exit device which has (a) means defining a bearing surface, (b) an action rod axially operable in a panic open direction and a locking direction, and (c) means joining said rod to said bearing surface for translation of said rod in opposite axial directions to operate a latch bolt comprising the steps of: selectively dampening and shock absorbing translation of said rod in said locking direction by (a) coupling shock absorber means to said rod only in said locking direction of axial translation and (b) allowing unrestricted translation of said rod in said panic open direction;

said coupling steps comprise (a) mounting a rod-support element to said bearing surface, (b) coupling an abutment to said rod, and (c) interpositioning a viscous-fluid-type shock absorber between said element and said abutment;

said interpositioning step comprises coupling a shock absorber holder to said element;

said mounting step comprises securing to said bearing surface a rod-support element which has a pair of parallel, side walls with apertures formed therein; and said interpositioning step further comprises (a) providing such an aforesaid holder which has a pair of resilient limbs, and (b) resiliently nesting portions of said limbs in said apertures.

* * * * *